United States Patent [19]

Bonfiglioli et al.

[11] Patent Number: 4,924,834

[45] Date of Patent: May 15, 1990

[54] INTEGRAL DEVICE FOR FORMING AND METERING A MIXTURE OF AIR AND FUEL IN AN INTERNAL COMBUSTION ENGINE FED BY A MULTIPOINT INJECTION SYSTEM

[75] Inventors: Silverio Bonfiglioli, Zola Predosa; Rino Stagni, S. Pietro In Casale, both of Italy

[73] Assignee: WEBER s.r.l., Turin, Italy

[21] Appl. No.: 365,858

[22] Filed: Jun. 14, 1989

Related U.S. Application Data

[63] Continuation of Ser. No. 264,807, Oct. 31, 1988, abandoned.

[30] Foreign Application Priority Data

Oct. 30, 1987 [IT] Italy ..... 67919 A/87

[51] Int. Cl.[5] ..... F02B 3/00; F02M 39/00

[52] U.S. Cl. ..... 123/470; 123/52 M

[58] Field of Search ..... 123/52 M, 52 MC, 339, 123/585, 472, 470, 471, 469, 468

[56] References Cited

U.S. PATENT DOCUMENTS

| | | | |
|---|---|---|---|
| 3,994,270 | 11/1976 | Nakano | 123/52 M |
| 4,323,041 | 4/1982 | Endo | 123/472 |
| 4,541,370 | 9/1985 | Sakai | 123/52 M |
| 4,567,860 | 2/1986 | Sugiyama . | |
| 4,643,136 | 2/1987 | Ura et al. . | |
| 4,716,879 | 1/1988 | Takayama | 123/472 |
| 4,726,337 | 2/1988 | Yoshida | 123/52 M |
| 4,726,340 | 2/1988 | Hasegawa | 123/52 M |
| 4,726,341 | 12/1988 | Muranaka | 123/339 |
| 4,726,343 | 2/1988 | Kruger | 123/472 |
| 4,751,905 | 6/1988 | Bonfiglioli | 123/470 |
| 4,768,487 | 9/1988 | Yamamoto | 423/470 |
| 4,771,751 | 9/1988 | Haigh | 123/468 |

FOREIGN PATENT DOCUMENTS

| | | | |
|---|---|---|---|
| 0094002 | 5/1983 | European Pat. Off. . | |
| 233697 | 8/1987 | European Pat. Off. . | |
| 261855 | 3/1988 | European Pat. Off. . | |
| 2409386 | 6/1979 | France . | |
| 59-192825 | 1/1984 | Japan . | |
| 0200062 | 11/1984 | Japan | 123/470 |
| 0232324 | 10/1986 | Japan | 123/52 M |
| 0291760 | 12/1986 | Japan | 123/52 M |
| 2203487 | 10/1988 | United Kingdom . | |

*Primary Examiner*—Carl Stuart Miller

*Attorney, Agent, or Firm*—Albert L. Jeffers; Anthony Niewyk

[57] ABSTRACT

The device comprises substantially an integral connection block for connection to an air manifold and to an engine wall; in said block there is provided a plurality of pairs of main air feed holes, one hole of each pair being controlled by a throttle valve; in the block there is also provided a series of supplementary idling air ducts the passage of which is controlled by a solenoid modulating valve housed in a suitable seat in the block. On the block there is also provided a series of seats for the injectors, and a pair of ducts for feeding fuel to the injectors and for its recirculation. Finally, on the block there are provided further seats for a fuel pressure regulator and for a pneumatic actuator arranged to control said throttle valves by way of a transmission.

9 Claims, 5 Drawing Sheets

INTEGRAL DEVICE FOR FORMING AND METERING A MIXTURE OF AIR AND FUEL IN AN INTERNAL COMBUSTION ENGINE FED BY A MULTIPOINT INJECTION SYSTEM

This is a continuation of application Ser. No. 264,807, filed Oct. 31, 1988, now abandoned.

BACKGROUND OF THE INVENTION

This invention relates to an integral device for forming and metering a mixture of air and fuel in an internal combustion engine of the type comprising a plurality of fuel injectors operated and controlled by a central electronic unit.

Devices of this type normally comprise an air manifold connected to the air filter by a duct the passage of which is controlled by a throttle valve, and a plurality of ducts for feeding air from said manifold to the combustion chamber of each engine cylinder. Each fuel injector is positioned along one of said ducts immediately upstream of the combustion chamber, and the fuel is fed to the injector through a pipe forming part of a fuel feed circuit, the fuel being fed into the circuit by an electrically driven pump at a predetermined pressure controlled by a suitable pressure controller.

The device also comprises a further duct which connects the region downstream of the air filter to said manifold and is controlled by a suitable valve to feed predetermined air quantities during engine cold starting, when the main duct controlled by the said throttle valve is almost completely closed by the valve. Devices of the aforesaid type have certain drawbacks.

Firstly they comprise completely separate components fixed in various ways to the engine or to the vehicle body and connected together by a large number of pipe portions to form the main feed air circuit, the cold start secondary air circuit and the fuel circuit.

Consequently such devices are of large overall size, require a large number of complicated operations for assembly, and are of poor reliability because of the ease with which said pipes provided between the various device components can separate or break.

Furthermore the operation of such devices is not optimised for basic engine operating conditions because of the constant volume of the air pipes which connect the various components together, and because of the high hydrodynamic resistance. In addition in certain applications, because of the presence of vapour in the petrol circuits there are hot start difficulties after stoppage.

SUMMARY OF THE INVENTION

The present invention provides a device for forming and metering a mixture of air and fuel in an internal combustion engine of the aforesaid type which is free of the said drawbacks.

Consequently a first object of the present invention is to provide a device in which the various components are strictly integrated so that it is of small overall size.

A further object of the present invention is to provide a device in which the connections made by pipes and ducts of various types between the components are substantially eliminated so that it becomes more reliable and can be mounted more simply and economically.

A further object of the present invention is to provide a device in which the volume present between the various device components are very small, in particular in the idling adjuster channels, to thus allow instantaneous response in the operation of the components.

A further object of the invention is to use in the device very small injectors of the bottom feed type which allow improved starting with the engine hot, and to use a low fuel pressure of the order of 1.5–2 bar, which is lower than the pressure normally used in multipoint systems, with the advantages of greater economy and reliability.

A still further object of the invention is to obtain improved engine performance in terms of increased delivered torque and power by the use of the device according to the invention.

These objects are attained by a device for forming and metering a mixture of air and fuel in an internal combustion engine comprising a plurality of electromagnetically operated and electronically controlled fuel injectors, characterised by comprising:

- at least one air manifold connected to the engine air filter by a duct the passage of which is controlled by at least one main throttle valve;
- an integral connection block for connection to said manifold and to a wall of the engine in which a plurality of holes is provided, each of which communicates with a corresponding combustion chamber of the engine;
- in said integral block there being provided a plurality of pairs of first and second main air feed holes disposed such that the two holes of each pair connect said manifold to one of said holes in the engine, air passage through the second holes of each pair being controlled by a corresponding second throttle valve;
- in said integral block there being provided a series of supplementary idling air ducts which connect an inlet hole in said block with said first main air feed holes, said block comprising a first seat for fixing a solenoid air modulating valve between said inlet hole and said supplementary idling air ducts;
- in said integral block there being provided a series of second seats each of which is arranged to allow fixing of one of said injectors, each of said seats communicating with at least one of said first main air feed holes;
- in said integral block there being provided a pair of fuel ducts, a first duct of which communicates with fuel inlet apertures in said injectors, and a second duct of which communicates with fuel outlet apertures in said injectors;
- in said integrated block there being provided a third seat for fixing a fuel pressure regulator interposed between a fuel inlet hole provided in said block and said first fuel duct.

BRIEF DESCRIPTION OF THE DRAWINGS

The present invention will be more apparent from the detailed description thereof given hereinafter by way of example with reference to the accompanying drawings in which.

DETAILED DESCRIPTION OF THE INVENTION

Figure 1:
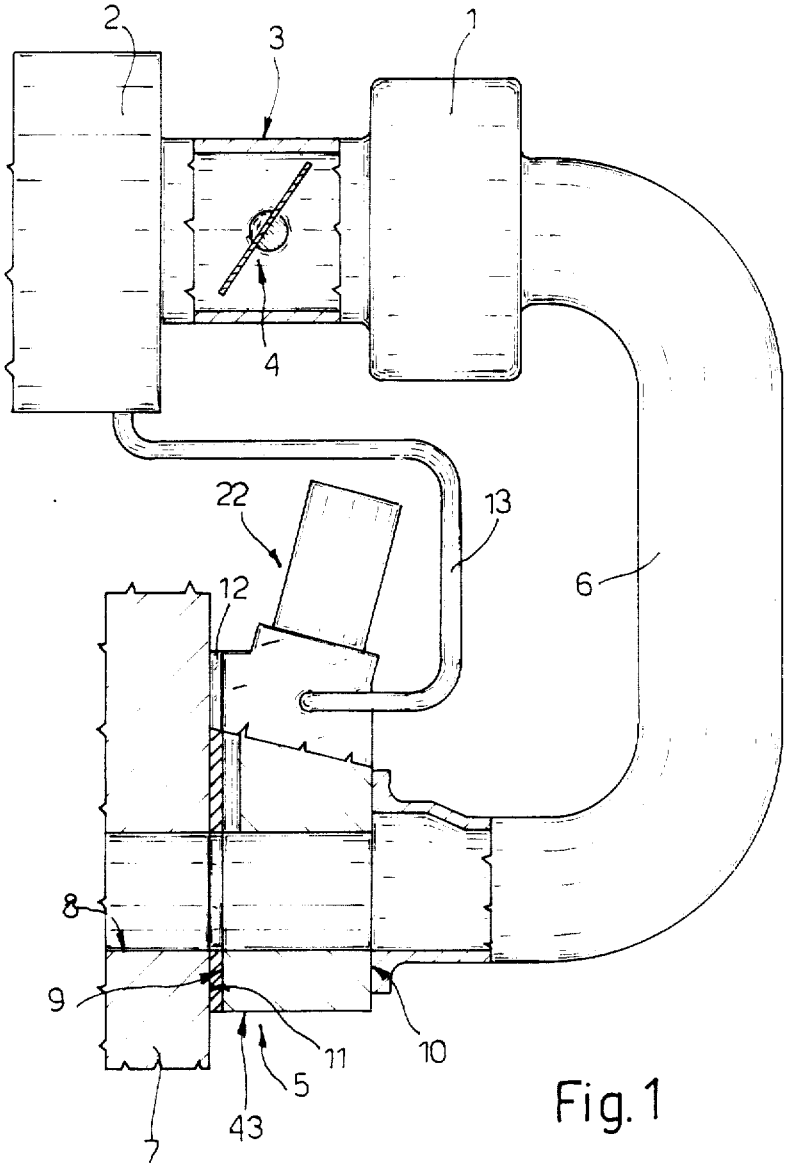
FIG. 1 is a partly sectional diagrammatic side view of the device of the invention.
Figure 2:
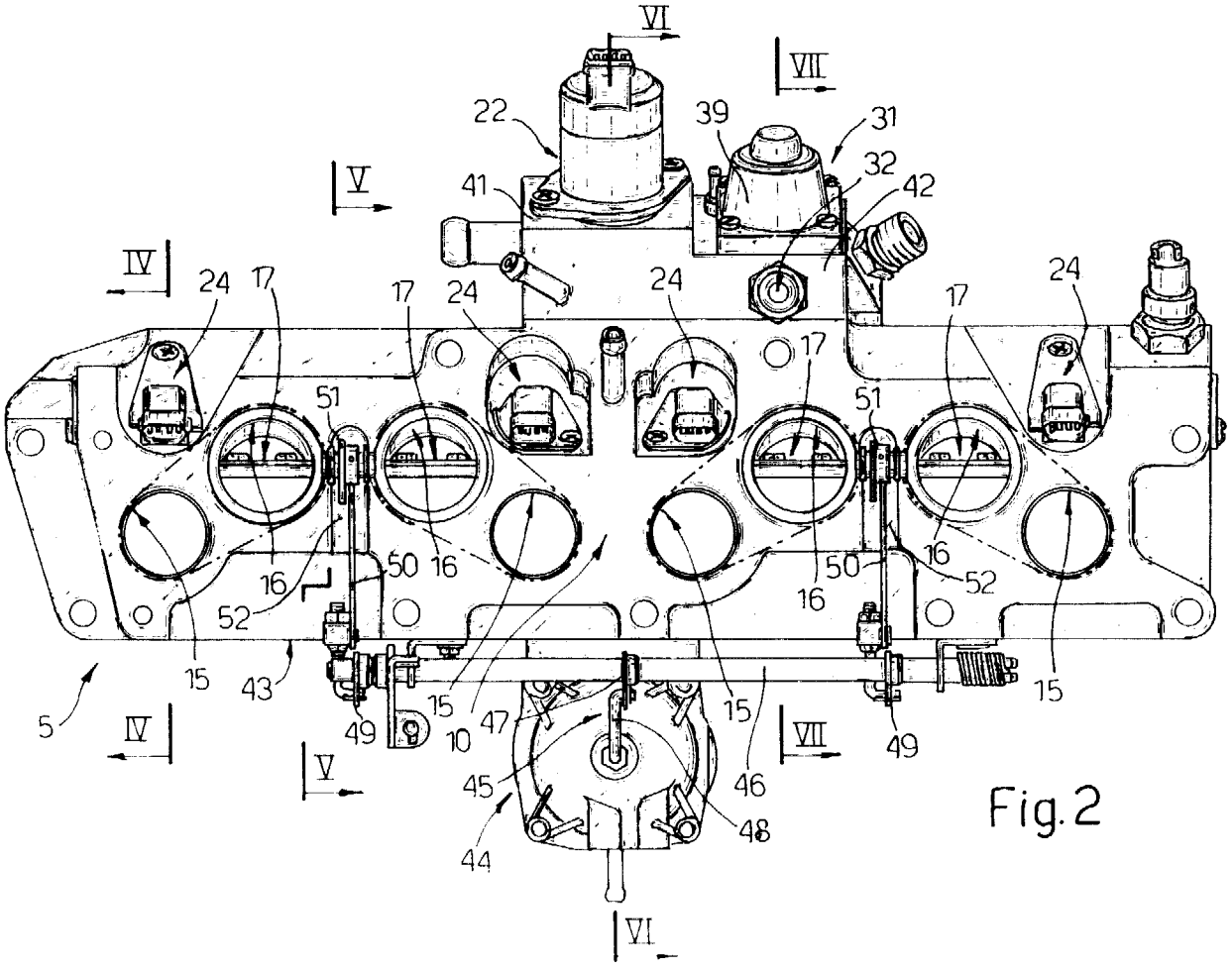
FIG. 2 is a view of the integral connection block forming part of the device of FIG. 1.

The device of the invention comprises substantially at least one air manifold, indicated overall by the reference numeral 1 (FIG. 1), and connected to the engine air filter 2 by a suitable throttled member 3, the passage of which is controlled by at least one main throttle valve 4.

The device also comprises an integral connection block indicated overall by 5, to be connected to the manifold 1 by suitable pipes 6 and to a wall 7 of the engine in which there is provided a plurality of holes 8 each communicating with a corresponding engine combustion chamber (not shown).

The integral connection block 5, shown in detail in FIGS. 2 to 7, is in the form substantially of a plate bounded by two substantially flat parallel main surfaces 9 and 10, the first of which is arranged to rest against a corresponding surface 11 (FIG. 1) of the engine 7 by way of a suitable flat mechanical-thermal gasket 12.

In the integral connection block 5 there is provided a plurality of pairs of first and second main air feed holes indicated by 15 and 16 respectively and disposed such that the two holes of each pair connect a duct 6 (FIG. 1) to one of the holes 8 in the engine. As can be clearly seen from the figures, air passage through the second holes 16 is controlled by a corresponding throttle valve 17.

Figure 3:
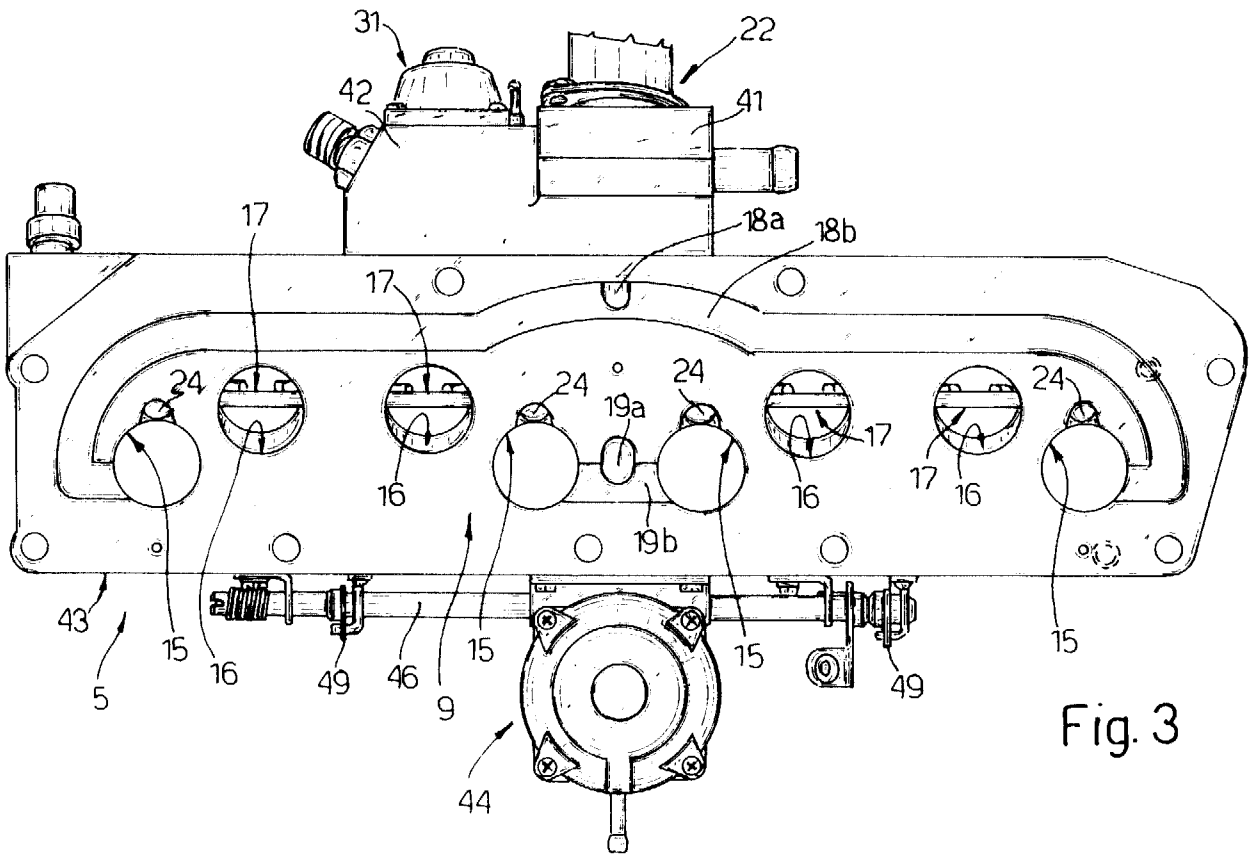
FIG. 3 is a further view, opposite to that of FIG. 2, of the integral connection block of the device.
Figure 7:
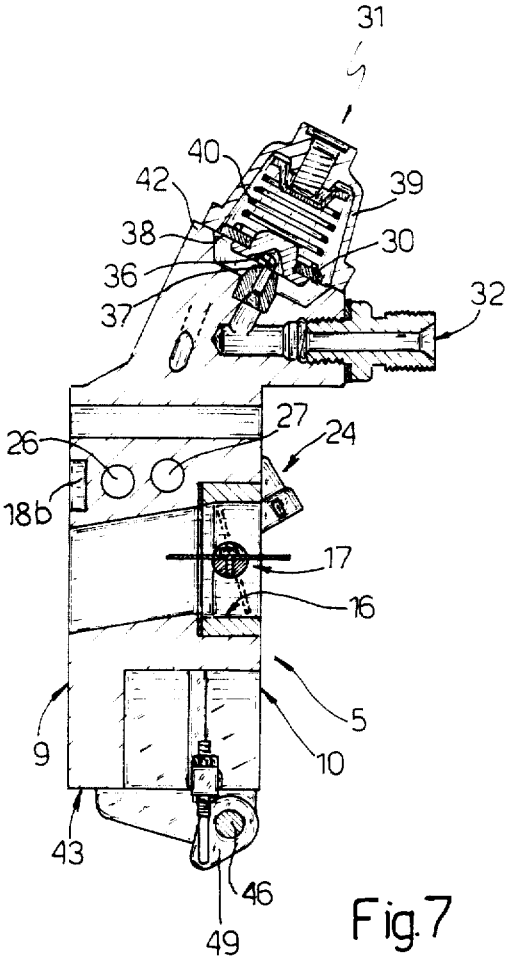
FIGS. 4 to 7 represent sections through the integral connection block of FIG. 2 on the lines IV—IV, V—V, VI—VI and VII—VII respectively.

In the integral connection block 5 there is also provided a series of supplementary air ducts **18*a*, 18*b*, 19*a*, 19*b* for connecting an air inlet pipe 13 (FIG. 1) downstream of the filter 2 to the main air feed holes 15 as clearly seen in FIG. 3. Conveniently, said supplementary air ducts comprise holes 18*a*, 19*a* and grooves 18*b*, 19*b* provided in the block on its surface 9 and which when the block is mounted on the engine as in FIG. 1** forms actual air ducts.

The block 5 also comprises a first seat 21 for fixing a solenoid air modulating valve 22 interposed between the inlet pipe 13 and the supplementary air ducts **18*a* and 19*a***.

In the block 5 there is also provided a series of second seats 23, each of which enables a fuel injector 24 to be fitted. Each of these seats communicates with a corresponding air feed hole 15 by way of a short hole 25 (FIG. 4).

In the block there is also provided a pair of fuel ducts 26, 27, of which the first communicates with injector fuel inlet apertures 28 and the second communicates with injector outlet apertures 29. There is also provided in the block a third seat 30 for fixing a fuel pressure regulator 31 interposed between a fuel inlet hole 32 provided in the block and the fuel feed duct 26 (FIG. 4). Connection between the hole 32 and duct 26 is by further holes, which are not visible in the sectional views shown. The purpose of the pressure regulator 31, which can be of any suitable type, is to keep the pressure within the feed duct 26 constant so as to enable part of the fuel to be discharged into a return duct when said pressure exceeds a predetermined value. The pressure regulator 31 (FIG. 7) can conveniently comprise a shutoff member 36 positioned along said fuel discharge duct and arranged to rest on a suitable seat 37. Said shutoff member is carried by a diaphragm 38 the edges of which are clamped by a cover 39 which is urged towards the seat 37 by the action of a helical spring 40.

As can be clearly seen from the figures, the main air feed holes 15 and 16 provided in the block 5 are through holes extending between the main surfaces 9 and 10 of the block and their axis is substantially orthogonal to said surfaces. The solenoid air modulating valve 22 and pressure regulator 31 are conveniently fixed onto upper projections 41 and 42 respectively (FIG. 6 and FIG. 7) of the block 5.

Figure 4:
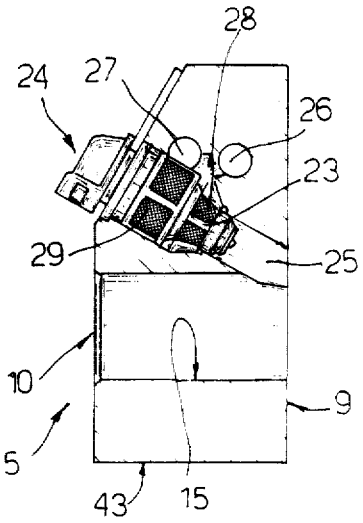
Figure 6:
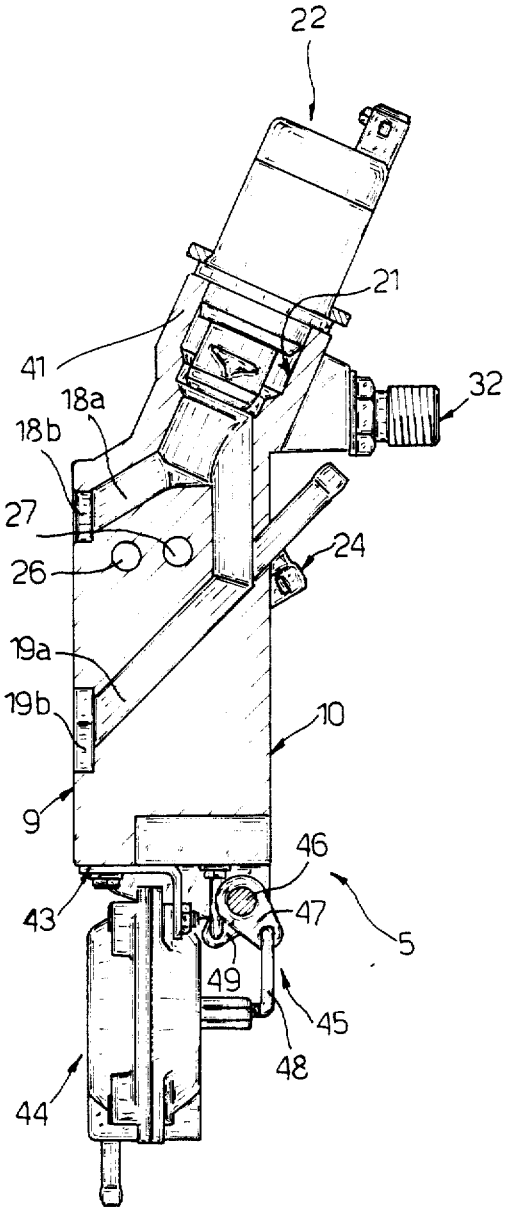
Figure 5:
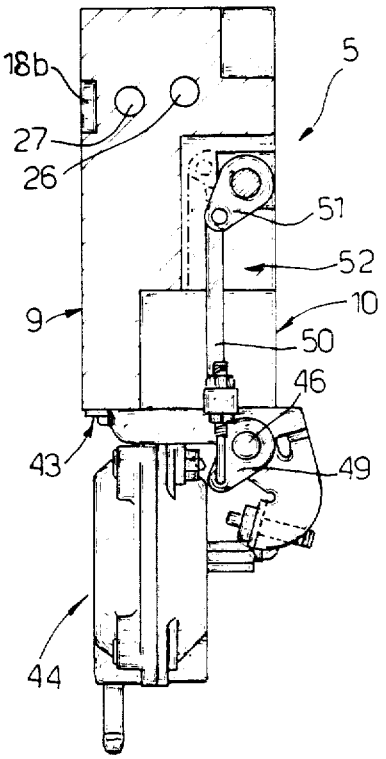

Each of the seats 23 of the injectors 24 is provided above the main air hole 16 and has its axis inclined to the hole axis as is clearly visible in FIG. 4. In addition, the fuel ducts 26 and 27 have their axis substantially parallel to the main surface 9 and 10 of the block 5.

The axes of the first main air holes 15 lie substantially in a first plane, while the axes of the second holes 16 lie in a second plane positioned above the preceding. Furthermore, conveniently, as shown clearly in FIG. 2, the holes are positioned such that pairs of first and second holes 15 and 16 are disposed side by side.

On the lower surface 43 of the block 5 there is fixed a pneumatic actuator 44 arranged to control the throttle valves 17 by way of a transmission indicated overall by 45. Said transmission can conveniently comprise a longitudinal spindle 46 provided with a crank 47 operated by a lever 48 of the actuator 44. Other cranks 49 (FIG. 5) are also connected to the spindle 46, each of these rotating by means of a connecting rod 50 a further crank 51 connected to a throttle valve 17. Grooves 52 are provided in the block 5 to house the connecting rods 50 and cranks 51. Conveniently the fuel pressure in the fuel ducts, and thus in particular in the duct 26 where it is kept constant, can be chosen particularly low, from 3 bar to below 1.0 bar. Consequently the fuel injectors 24 are also of a type suitable for low pressure circuits such as bottom feed injectors, and are of similar dimensions than the standard type used in multipoint systems. The device of the invention operates as follows.

The throttled member 3, the manifold 1, the ducts 6 (FIG. 1) and the holes 15 and 16 of the integral connection block 5 form a main air circuit. The air through this circuit can be throttled by operating the valve plate 4 of the throttled member 3, and also by each throttle valve 17 which controls the passage through a corresponding hole 16. In this manner it is possible to rigorously control the air fed into each combustion chamber, and in particular to feed large quantities of air such as required to provide high power.

The pipe 13, the hole 20 and the ducts **18*a*, 18*b*, 19*a*, 19*b* controlled by the modulating valve 22** form a second supplementary air circuit. This further circuit feeds air during engine cold starting and for controlling the idling speed.

The fuel circuit comprises the inlet hole 32 and ducts 26 and 27, and also other holes which are not shown but which connect the hole 32 to the ducts 26 and 27. The pressure in the feed duct 26 is suitably controlled by the pressure regulator 31.

It is therefore apparent that besides enabling the fuel mixture to be formed and metered to suit any engine operating condition, the device of the invention is of very small overall size as the main device components are completely integral with the connection block 5.

In addition it is of high reliability as the various components are connected together directly by means of holes and ducts provided within said block. There can therefore be no breakage of pipes or their separation from the corresponding connectors as happens in the described previous devices.

Again, because of the small volume of the holes which connect together the various device components, these can be activated very rapidly. Finally, the operations involved in mounting the device on a motor vehicle are very simple and rapid to perform as most of the components are fixed integrally onto the connection block 5. This can therefore be prepared on the workbench by directly mounting the main device members and components on it, this being done with considerable precision and speed.

It is apparent that modifications can be made to the form and arrangement of the various parts of the device according to the invention, but without leaving the scope of the inventive field.

We claim:

1. A device for forming and metering a mixture of air and fuel in an internal combustion engine comprising a plurality of electromagnetically operated and electronically controlled bottom-feed fuel injectors (24), characterized by comprising:

at least one air manifold (1) connected to the engine air filter (2) by a duct (3) the passage of which is controlled by at least one main throttle valve (4);

an integral connection block (5) for connection to said manifold and to a wall (7) of the engine in which a plurality of holes (8) is provided, each of which communicates with a corresponding combustion chamber of the engine;

in said integral block there being provided a plurality of pairs of first (15) and second (16) main air feed holes disposed such that the two holes (15, 16) of each pair connect the manifold (1) to one of said holes (8) in the engine, air passage through the second holes (16) of each pair being controlled by a corresponding second throttle valve (17);

in said integral block (5) there being provided a series of supplementary idling air ducts (18*a*, 18*b*, 19*a*, 19*b*) which connect an air inlet hole in said block to said first main air feed holes (15), said block (5) comprising a first seat (21) for fixing a solenoid air modulating valve (22) between said air inlet hole and said supplementary idling air ducts (18*a*, 18*b*, 19*a*, 19*b*);

in said integral block there being provided a series of second least one of said first main air feed holes (15);

in said integral block (5) there being provided a pair of fuel ducts (26, 27), a first duct (26) of which communicates with fuel inlet apertures (28) in said injectors, and a second duct (27) of which communicates with fuel outlet apertures (29) in said injectors;

in said integrated block (5) there being provided a third seat (30) for fixing a fuel regulator (31) interposed between a fuel inlet hole (32) provided in said block and said first fuel duct (26).

2. A device as claimed in claim 1, characterised in that said integral block (5) is in the form of a plate bounded by a pair of parallel flat main surfaces (9, 10), a first of said main surfaces (9) being arranged to rest against a corresponding flat surface (11) of said engine wall (7), said main air feed holes (15, 16) being through holes provided between said two main surfaces of the plate (9, 10) and being substantially inclined to said surfaces.

3. A device as claimed in claim 1, characterised in that at least a portion of each of said supplementary air ducts is generated by a groove (18*b*, 19*b*) which is provided in said first main surface (9) of said block (5) and is closed by said engine surface (11), said first seat (21) for fixing a solenoid modulating valve (22) for the supplementary idling air being provided in a first upper projection (41) of said block (5).

4. A device as claimed in claim 1, characterised in that each of said second seats (23) for the injectors (24) is provided above one of said main air holes (15) and has its axis inclined to the axis of said hole, said pair of fuel ducts (26, 27) comprising a pair of duct portions having their axis parallel to said first main surface (9) of said block (5).

5. A device as claimed in claim 1, characterised in that said third seat (30) for fixing the fuel pressure regulator (31) is provided on a second upper projection (42) of said block adjacent to said first projection (41).

6. A device as claimed in claim 1, characterised in that the axes of said first main air holes (15) lie substantially in a first plane and the axes of said second main air holes (16) lie in a second plane disposed above the preceding, the holes of each of said pairs (15, 16) being disposed in such a manner that two first holes (15) and two second holes (16) are side by side.

7. A device as claimed in claim 1, characterised in that on the lower surface (43) of said block there is fixed a pneumatic actuator (44) arranged to control said second throttle valves (17) by way of a transmission (45), there being provided in said block between two second holes (16) a vertical groove (52) arranged to house certain members of said transmission.

8. A device as claimed in claim 1, characterised in that the fuel pressure in said fuel ducts (26) can be maintained below 1.5 bar by said pressure regulator (31).

9. A device as claimed in claim 1, characterised in that said fuel injectors are of the bottom feed type and suitable for operation at low pressure, each of said injectors being fed at its front end.

* * * * *

UNITED STATES PATENT AND TRADEMARK OFFICE

CERTIFICATE OF CORRECTION

PATENT NO. : 4,924,834

DATED : May 15, 1990

INVENTOR(S) : Silverio Bonfiglioli et al

It is certified that error appears in the above-identified patent and that said Letters Patent is hereby corrected as shown below:

Claim 1:

Col. 5, line 43, after "second" insert --seats (23) each of which is arranged to allow fixing of one of said injectors (24), each of said seats communicating with at--

Signed and Sealed this

Twentieth Day of August, 1991

*Attest:*

*Attesting Officer*

HARRY F. MANBECK, JR.

*Commissioner of Patents and Trademarks*